US010085609B2

(12) United States Patent
Meurrens

(10) Patent No.: US 10,085,609 B2
(45) Date of Patent: Oct. 2, 2018

(54) HAND-HELD CLEANING APPARATUS FOR TOUCH SCREENS

(75) Inventor: Peter Meurrens, Burnaby (CA)

(73) Assignee: Parkside Optical Inc., Vancouver (CA)

( * ) Notice: Subject to any disclaimer, the term of this patent is extended or adjusted under 35 U.S.C. 154(b) by 1102 days.

(21) Appl. No.: 13/977,440

(22) PCT Filed: Dec. 31, 2010

(86) PCT No.: PCT/CA2010/002083

§ 371 (c)(1),
(2), (4) Date: Jul. 17, 2013

(87) PCT Pub. No.: WO2012/088581

PCT Pub. Date: Jul. 5, 2012

(65) Prior Publication Data

US 2013/0284206 A1 Oct. 31, 2013

(51) Int. Cl.

| | |
|---|---|
| ***A47L 1/15*** | (2006.01) |
| ***A47L 13/17*** | (2006.01) |
| ***C11D 17/00*** | (2006.01) |
| ***A47L 25/00*** | (2006.01) |
| ***B08B 1/00*** | (2006.01) |
| ***B08B 13/00*** | (2006.01) |
| ***C11D 7/02*** | (2006.01) |
| ***C11D 17/04*** | (2006.01) |

(52) U.S. Cl.

CPC ..... *A47L 13/17* (2013.01); *A47L 1/15* (2013.01); *A47L 25/00* (2013.01); *B08B 1/00* (2013.01); *B08B 13/00* (2013.01); *C11D 7/02* (2013.01); *C11D 17/049* (2013.01)

(58) Field of Classification Search

CPC ..... A47L 1/15; A47L 13/17

See application file for complete search history.

(56) References Cited

U.S. PATENT DOCUMENTS

| | | | | |
|---|---|---|---|---|
| 2,414,872 A | | 1/1947 | Harter | |
| 3,214,779 A | * | 11/1965 | Wheeler | A47K 11/10 15/144.2 |
| 5,361,442 A | * | 11/1994 | Payne | E04H 4/1609 15/1.7 |
| D362,092 S | | 9/1995 | Wasak | |

(Continued)

FOREIGN PATENT DOCUMENTS

| | | |
|---|---|---|
| CA | 2272315 A1 | 5/1999 |
| CA | 108194 | 12/2006 |

(Continued)

*Primary Examiner* — Randall Chin

(74) *Attorney, Agent, or Firm* — Oyen Wiggs Green & Mutala LLP

(57) ABSTRACT

A hand-held apparatus employing a non-liquid cleaning composition for cleaning touch screen is described. In one embodiment, the apparatus comprises a hand-held cleaning instrument and a cap. The hand-held cleaning instrument comprises a handle and a replaceable cleaning pad. The cleaning pad comprises an engagement mechanism for removably coupling the cleaning pad to the handle. When not in use, the cleaning pad may be folded and received in the cap in a stowed configuration. When in use, the cap is removed and the cleaning pad is deployed in an extended position. The cleaning composition on the cleaning pad comprises a combination of carbon black and a hemihydrate of calcium sulfate.

20 Claims, 11 Drawing Sheets

(56) References Cited

U.S. PATENT DOCUMENTS

| | | | | | |
|---|---|---|---|---|---|
| 5,615,440 | A * | 4/1997 | Cowan | A47L 23/05 | 15/104.94 |
| 5,918,342 | A * | 7/1999 | Smith | A47L 13/24 | 15/144.1 |
| 5,993,560 | A * | 11/1999 | Wasak | A46B 7/023 | 134/42 |
| D420,807 | S | 2/2000 | Otteman et al. | | |
| 6,973,695 | B1 * | 12/2005 | Nesler | A47L 1/06 | 15/144.2 |
| D566,360 | S | 4/2008 | Ungaro | | |
| D670,879 | S | 11/2012 | Meurrens | | |

FOREIGN PATENT DOCUMENTS

| | | |
|---|---|---|
| CA | 113401 | 7/2007 |
| CA | 109294 | 9/2007 |
| WO | 93/07523 A1 | 4/1993 |

* cited by examiner

HAND-HELD CLEANING APPARATUS FOR TOUCH SCREENS

TECHNICAL FIELD

The present invention relates to hand-held cleaning apparatuses, in particular hand-held cleaning apparatuses for cleaning touch screens. The present invention also relates to non-liquid cleaning compositions for cleaning touch screens. Further, the present invention relates to methods for cleaning touch screens.

BACKGROUND

Touch screens are used in many electronic and digital devices, including hand-held computers (e.g., iPad™ tablet computers sold by Apple Inc.), e-book readers, smartphones, mobile phones, personal digital assistants (PDAs), satellite navigation systems, video game displays, computer-assisted learning terminals, point of sale systems, kiosk systems, airport check-in systems, and the like.

Use of touch screen computers has increased in popularity since Apple Inc. released its iPad™ tablet computers in April 2010. It is reported that 7.5 million units of iPad™ tablet computers were sold worldwide in the months from April to September 2010 alone.

Since a touch screen device requires a user's fingers to directly touch the screen, fingerprints are repeatedly transferred to the screen surface. The amount of oily residue deposited on tablet computer touch screens and the like can quickly accumulate. Because a typical tablet computer has a relatively large touch screen (for example, a typical iPad™ tablet computer has a 20 cm×16 cm touch screen), the amount of fingerprint oil accumulated on the tablet computer screen can be large. The fingerprint smudges are not only unsightly but can also reduce the viewability of content displayed on the screen. One possible method to remove the fingerprints from a smudged touch screen is to apply a small amount of water to a cloth and then rub the damp cloth against the touch screen. However, this method tends to leave oily streaks on the touch screen and may damage electronic components if moisture penetrates into the interior of the device.

The inventor has determined that it would be desirable to provide an apparatus for cleaning touch screens that employs a non-liquid cleaning composition that safely removes oily residues without smearing or streaking the touch screen surface.

BRIEF DESCRIPTION OF DRAWINGS

In drawings which show non-limiting embodiments of the invention.

DETAILED DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Figure 1:
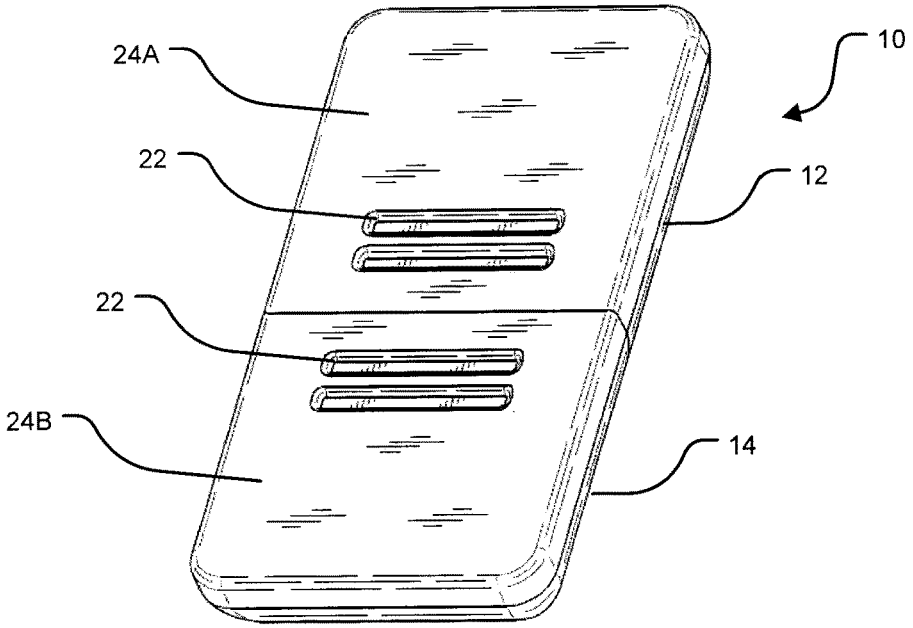
FIG. 1 is a bottom perspective view of an embodiment of a hand-held cleaning apparatus for cleaning touch screens showing a removable cap coupled to the apparatus handle.
Figure 2:
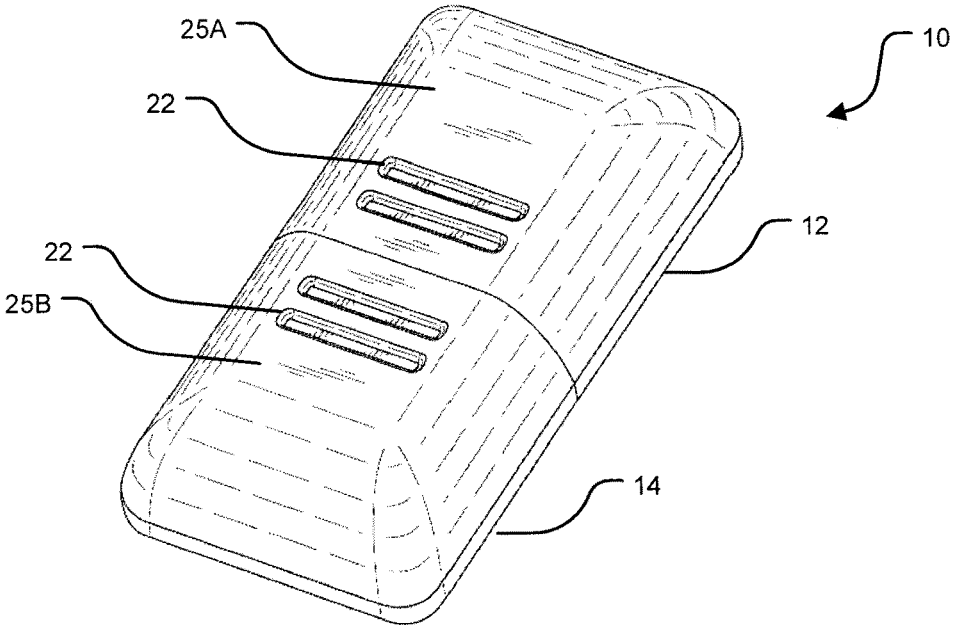
FIG. 2 is a top perspective view of the apparatus of FIG. 1.
Figure 3:
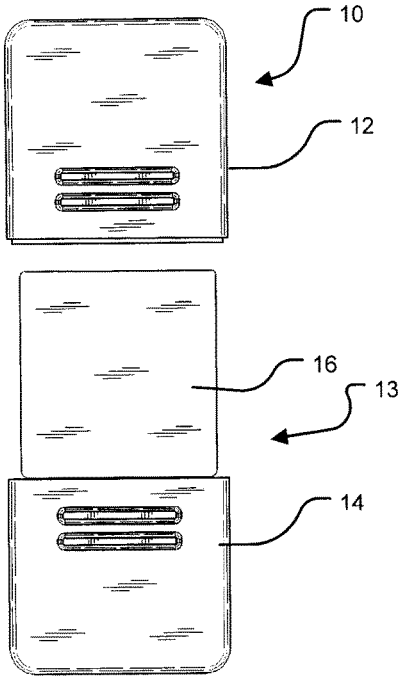
FIG. 3 is a bottom plan view of the apparatus of FIG. 1 with the cap removed and showing a cleaning pad in a folded position.
Figure 4:
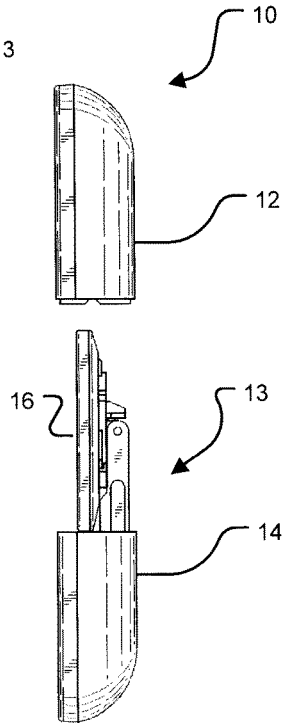
FIG. 4 is a side elevation view of the apparatus of FIG. 3.
Figure 5:
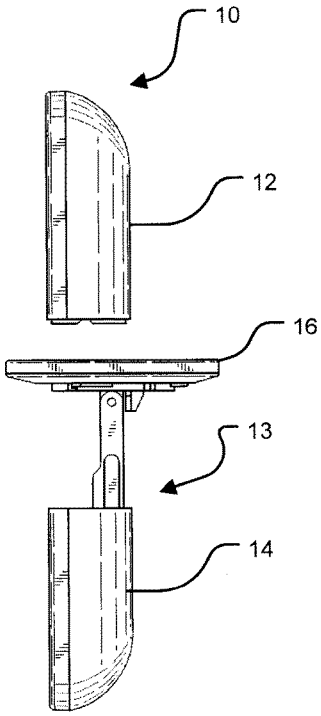
FIG. 5 is a side elevation view of the apparatus of FIG. 4 with the cap removed and showing the cleaning pad in an extended position.
Figure 6:
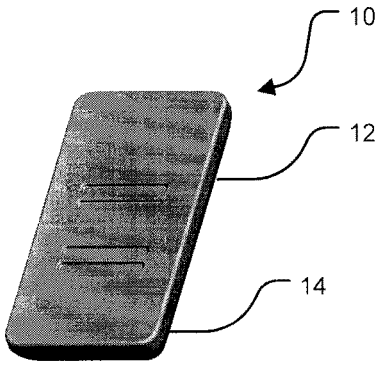
FIG. 6 is a further bottom perspective view of the apparatus of FIG. 1.
Figure 7:
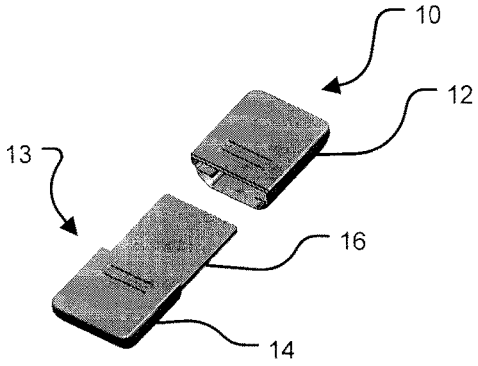
FIG. 7 is a bottom perspective view of the apparatus of FIG. 6 with the cap removed and showing the cleaning pad in the folded position.
Figure 8:
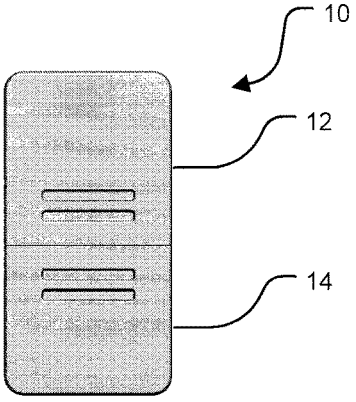
FIG. 8 is a bottom plan view of the apparatus of FIG. 6.
Figure 9:
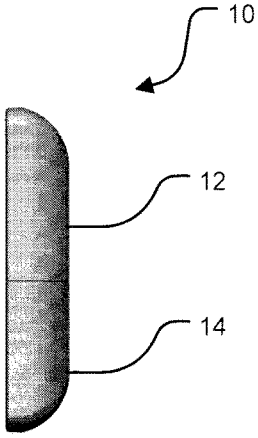
FIG. 9 is a side elevation view of the apparatus of FIG. 6.
Figure 10:
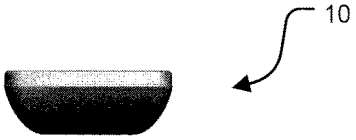
FIG. 10 is an end elevation view of the apparatus of FIG. 6.
Figure 17:
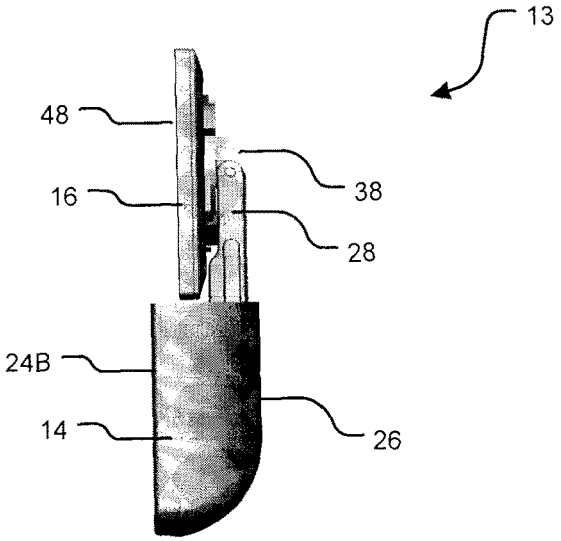
FIG. 17 is a side elevation view of the apparatus of FIG. 16 showing the cleaning pad in the folded position.
Figure 18:
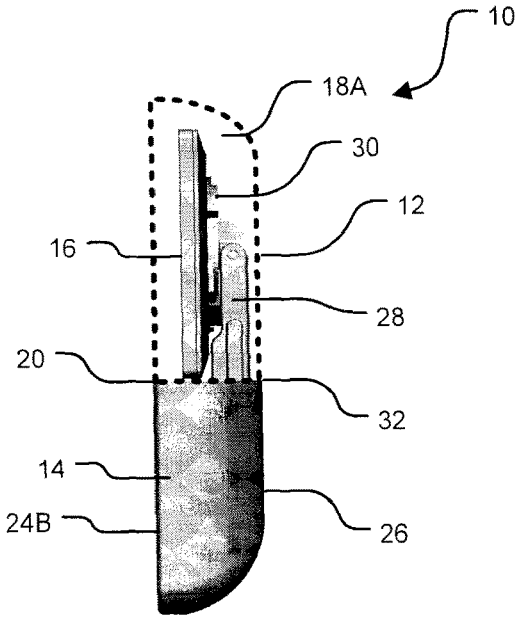
FIG. 18 is a side elevation view of apparatus of FIG. 17 showing the cap in phantom outline coupled to the handle and showing the cleaning pad in the folded position.

FIGS. 1-18 show a cleaning apparatus 10 according to one embodiment of the invention. FIGS. 1, 2, 6, 8-10 and 18 are various views of apparatus 10 in a stowed configuration with a cap 12 removably coupled to a handle 14. As best shown in FIG. 18, cap 12 encloses a cleaning pad 16. Pad 16 is pivotally coupled to handle 14 and is adjustable between folded and extended positions as described further below. FIGS. 3, 4 and 7 show apparatus 10 in a partially deployed configuration with cap 12 removed and pad 16 in the folded position. FIG. 5 shows apparatus 10 in a fully deployed configuration with cap 12 removed and pad 16 in the extended position.

Further details of apparatus 10 are described with reference to the exploded view of the component parts of apparatus 10 shown in FIG. 11. Cap 12 defines a hollow inner compartment 18. Compartment 18 has an open end and a closed end, and has a rim 20 at the open end. Cap 12 may optionally comprise grooves 22 formed on a bottom surface 24A (FIG. 1) and/or a top surface 25A (FIG. 2) thereof for enabling a user to easily grip cap 12. In the illustrated embodiment, two flanges 27A, 27B are attached to opposed inner side walls of cap 12 partway between surfaces 24A, 25A. Flanges 27A, 27B define a first slot 29A and a second slot 29B formed in the interior of compartment 18.

As shown in FIGS. 3-5, apparatus 10 includes a hand-held cleaning instrument 13 comprising handle 14 and cleaning pad 16. With reference to FIG. 11, handle 14 comprises a body portion 26, an elongated neck portion 28, and a head portion 30. Body portion 26, neck portion 28, and head portion 30 are typically formed of a rigid material, for example, plastic, aluminum, or stainless steel. Body portion 26 has a rim 32 at one end. Rim 32 has a cross section that is generally the same shape as the cross section of rim 20 of cap 12 to enable cap 12 and handle 14 to snugly fit together. Cap 12 and handle 14 together form a sealed enclosure 18A (labeled in FIG. 18) that houses other components of cleaning apparatus 10 (e.g., cleaning pad 16, neck portion 28, head portion 30). As explained further below, this prevents contamination of cleaning pad 16 when apparatus 10 is not in use and also prevents the cleaning composition on cleaning pad 16 from being inadvertently transferred to other articles.

Body portion 26 of handle 14 may be hollow or solid. In the illustrated embodiment, body portion 26 has a generally flat bottom surface 24B, a generally flat upper surface 25B, and two curved side walls. Body portion 26 may optionally comprise grooves 22 on bottom surface 24B (FIG. 1) and/or top surface 25B (FIG. 2) for enabling a user to easily grip body portion 26.

Neck portion 28 is fixedly or removably coupled to body portion 26. When coupled to body portion 26, neck portion 28 extends outwardly from body portion 26 at a fixed angle relative to a plane defined by bottom surface 24B. For example, the fixed angle may be in the range of 0° to 30°. In the illustrated embodiment (e.g. FIG. 16), neck portion 28 is oriented generally parallel to bottom surface 24B.

Figure 15:
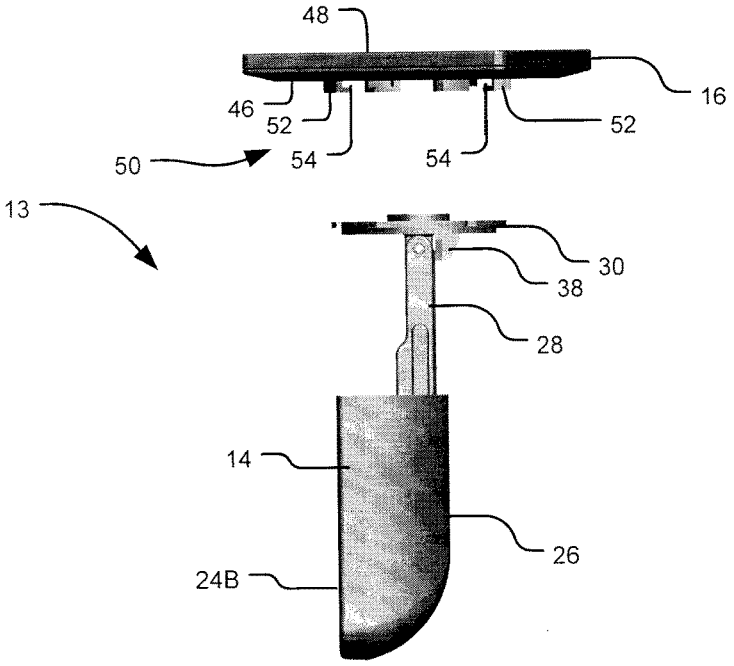
FIG. 15 is a side elevation view of the apparatus of FIG. 13.
Figure 16:
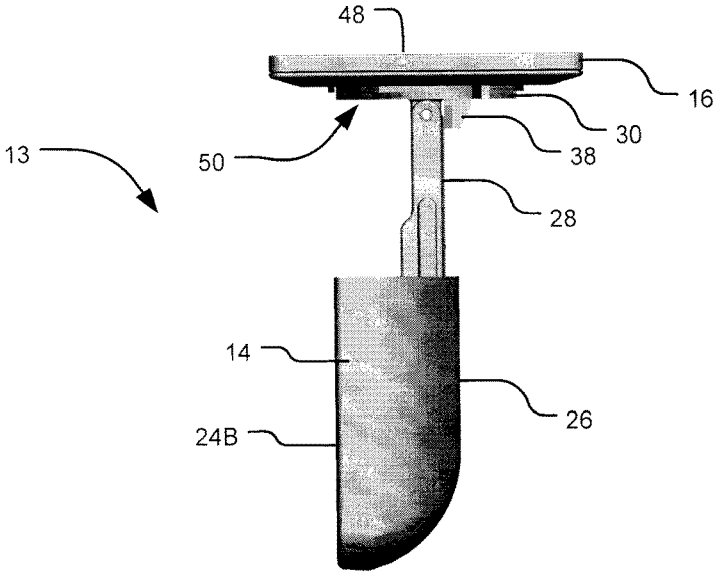
FIG. 16 is a side elevation view of the apparatus of FIG. 14.

Head portion 30 is pivotally coupled to neck portion 28 at or near an end thereof removed from body portion 26. As shown in FIGS. 15 and 16, cleaning pad 16 is mounted on head portion 30. A connector 34 for pivotally mounting head portion 30 to neck portion 28 is provided (FIG. 11). Handle 14 comprises a biasing element 36 (not indicated in FIG. 11, but indicated in FIGS. 12-14) that is coupled to head portion 30. In some embodiments, biasing element 36 comprises a spring. Biasing element 36 biases head portion 30, and attached cleaning pad 16, to pivotally move relative to neck portion 28. As best seen in FIGS. 15-16, the maximum range of pivotal movement of head portion 30 relative to neck portion 28 is limited by one or more abutment members 38 which are provided on head portion 30. When head portion 30 pivotally moves relative to neck portion 28 to the extent that abutment members 38 contact neck portion 28, abutment members 38 prevents further pivotal movement of head portion 30. In some embodiments, abutment members 38 prevent head portion 30 from pivotally moving beyond a predetermined angle (e.g., 90°, 100°, 110°, or 120° or the like) relative to neck portion 28.

Head portion 30 and attached cleaning pad 16 is thus pivotally movable between the folded position (FIG. 17) and the extended position (FIG. 16). Head portion 30 is biased toward the extended position when cap 12 is removed from handle 14 (FIG. 16). As shown in the drawings and described further below, head portion 30 is in the folded position when head portion 30 is received inside cap 12 (FIG. 18).

Figure 11:
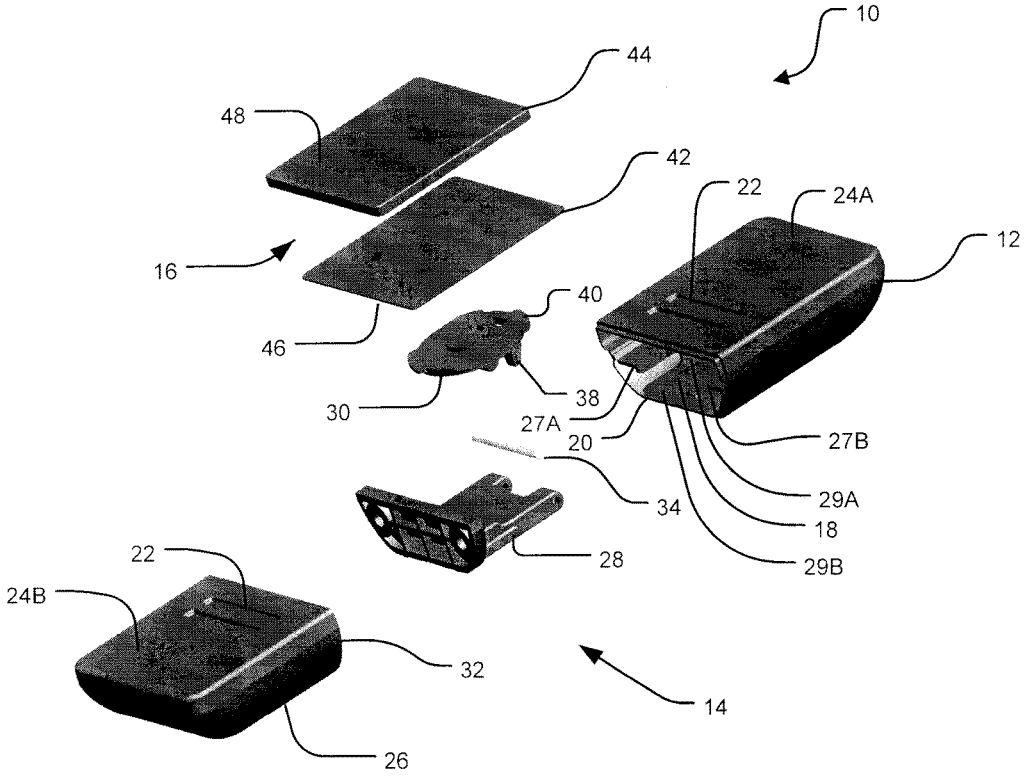
FIG. 11 is an exploded view of the component parts of the apparatus of FIGS. 1-10.
Figure 12:
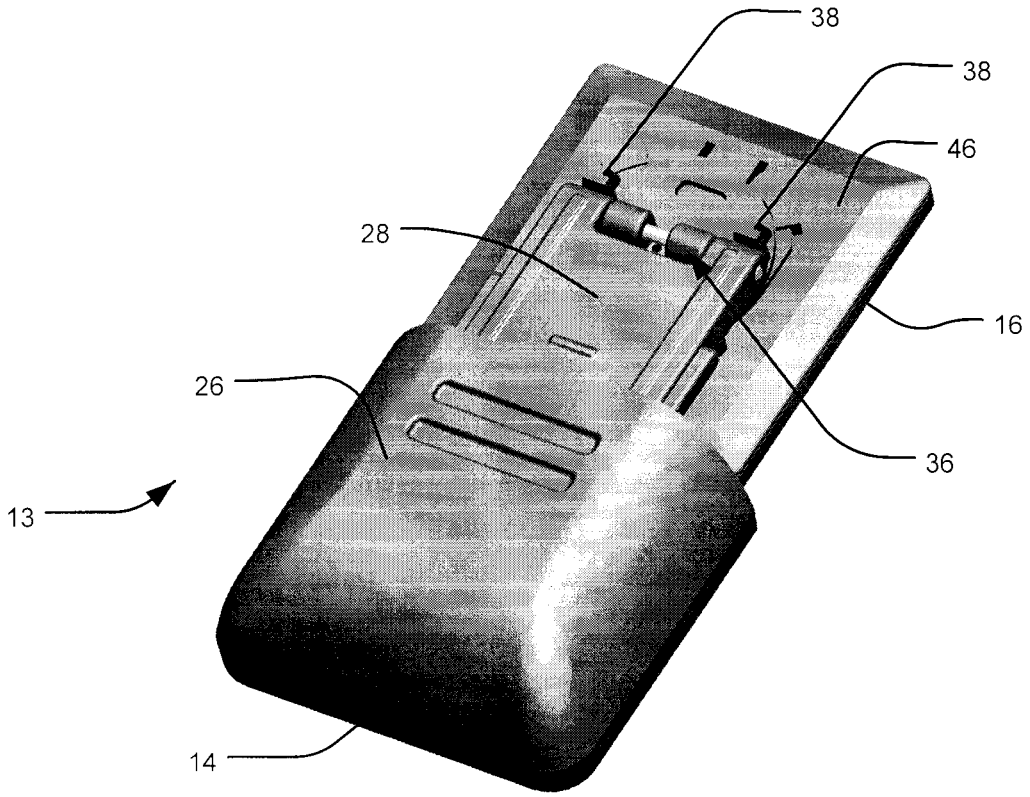
FIG. 12 is a top perspective view of the apparatus of FIG. 7 with the cap removed and showing the cleaning pad in the folded position.
Figure 13:
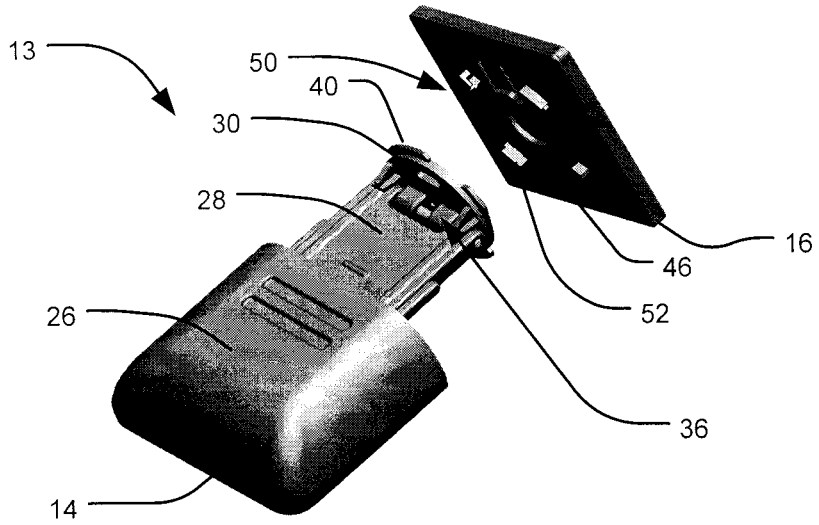
FIG. 13 is a top perspective view of the apparatus of FIG. 12 wherein the cleaning pad is detached from the handle.
Figure 14:
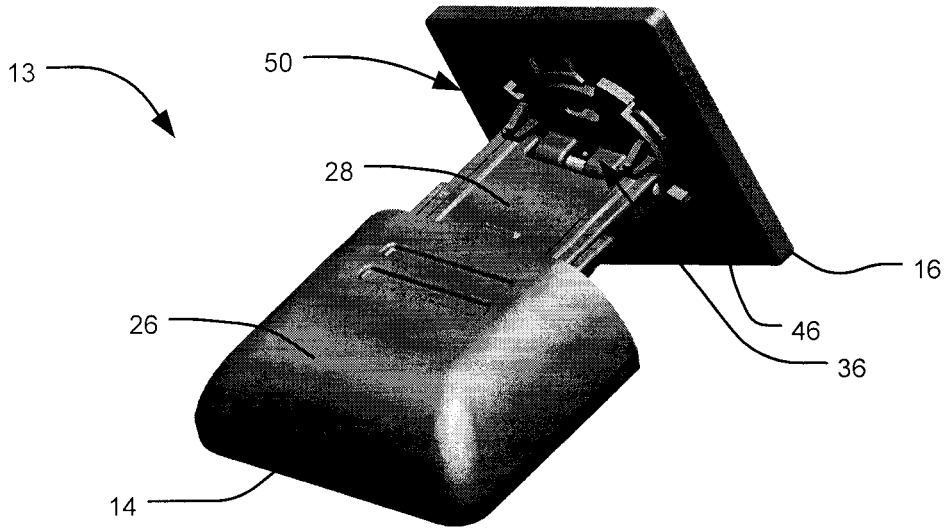
FIG. 14 is a top perspective view of the apparatus of FIG. 13 wherein the cleaning pad is attached to the handle and is shown in the extended position.
Figure 19:
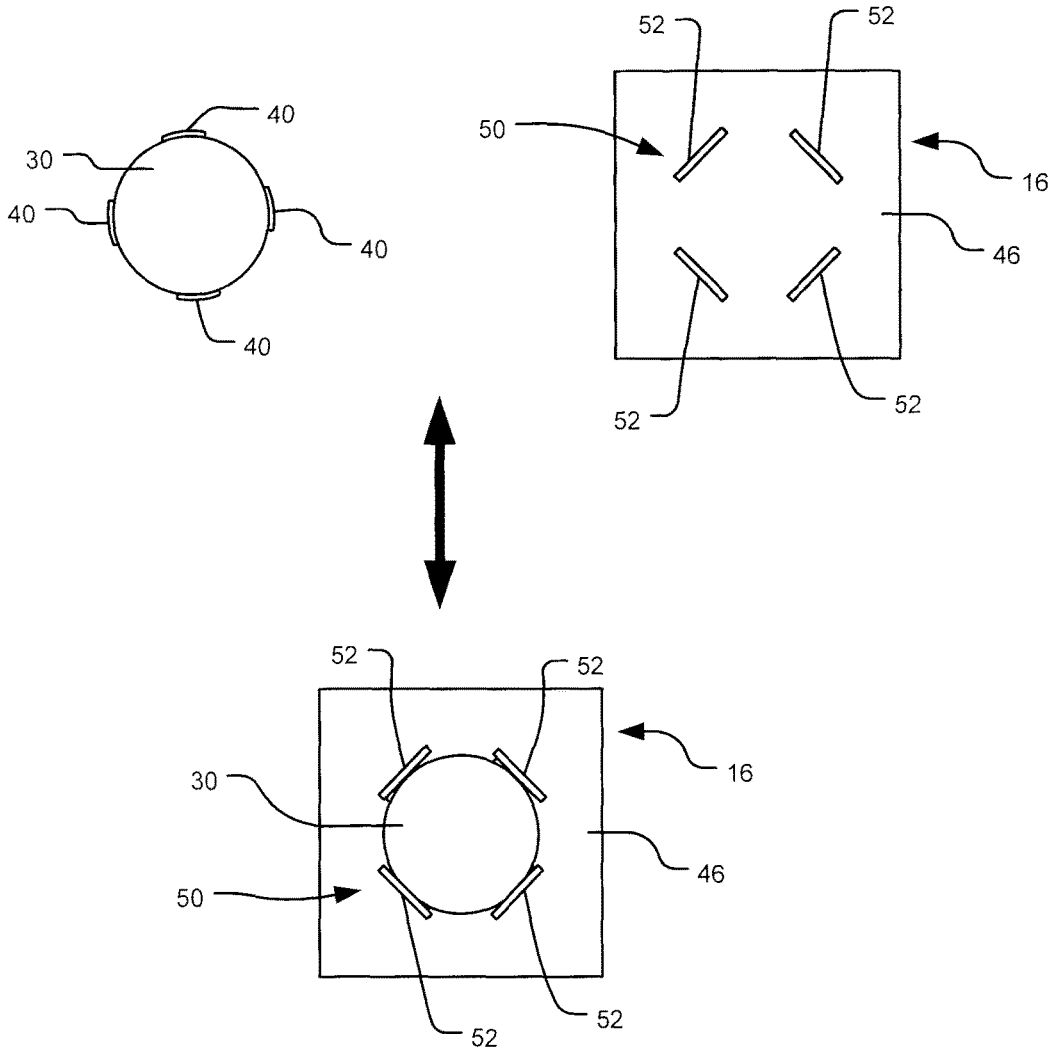
FIG. 19 shows schematic plan views of an embodiment of a head portion of the handle for coupling to an engagement mechanism of the cleaning pad.

In FIG. 11, head portion 30 is shown as a generally planar structure having a plurality of horizontally extending ridges 40. An embodiment of head portion 30 having extending ridges 40 is also shown in FIG. 19. The function of ridges 40 is for coupling cleaning pad 16 to head portion 30 and will be described in further detail later. In FIG. 11, head portion 30 is generally shaped like a circular disk, but this is not mandatory. Head portion 30 may be of other shapes such as square, rectangular, oval, polygonal, or the like.

In the illustrated embodiment, cleaning pad 16 is removably coupled to head portion 30 and is replaceable. As shown in FIG. 11, cleaning pad 16 comprises a base member 42 and a pad member 44 which is bonded to base member 42. Base member 42 defines an undersurface 46 of cleaning pad 16 and may be formed of a rigid material. Pad member 44 may be formed from a microfiber cloth, or natural or synthetic chamois leather, or other suitable material. A cleaning surface 48 is provided on pad member 44 for contacting a touch screen. Cleaning surface 48 and undersurface 46 are located on opposite sides of cleaning pad 16.

As indicated above, cleaning pad 16 is removably connectable to head portion 30 of handle 14. As shown in FIGS. 13-16 and 19-20, an undersurface 46 of cleaning pad 16 comprises an engagement mechanism 50 for removably coupling cleaning pad 16 to head portion 30 of handle 14. In the embodiment in FIGS. 13-16 and 19, engagement mechanism 50 comprises a plurality of projections 52, each extending from undersurface 46 and defining a groove 54 (visible in FIG. 15) for slidably receiving one of the ridges 40 on head portion 30, thereby coupling cleaning pad 16 to head portion 30. The coupling between head portion 30 and cleaning pad 16 allows pressure or torque applied to handle 14 to be transmitted to cleaning pad 16. In FIG. 19, projections 52 are arranged generally radially with respect to a geometric centre of cleaning pad 16. Corresponding ridges 40 are also arranged generally radially with respect to a geometric centre of head portion 30.

Figure 20:
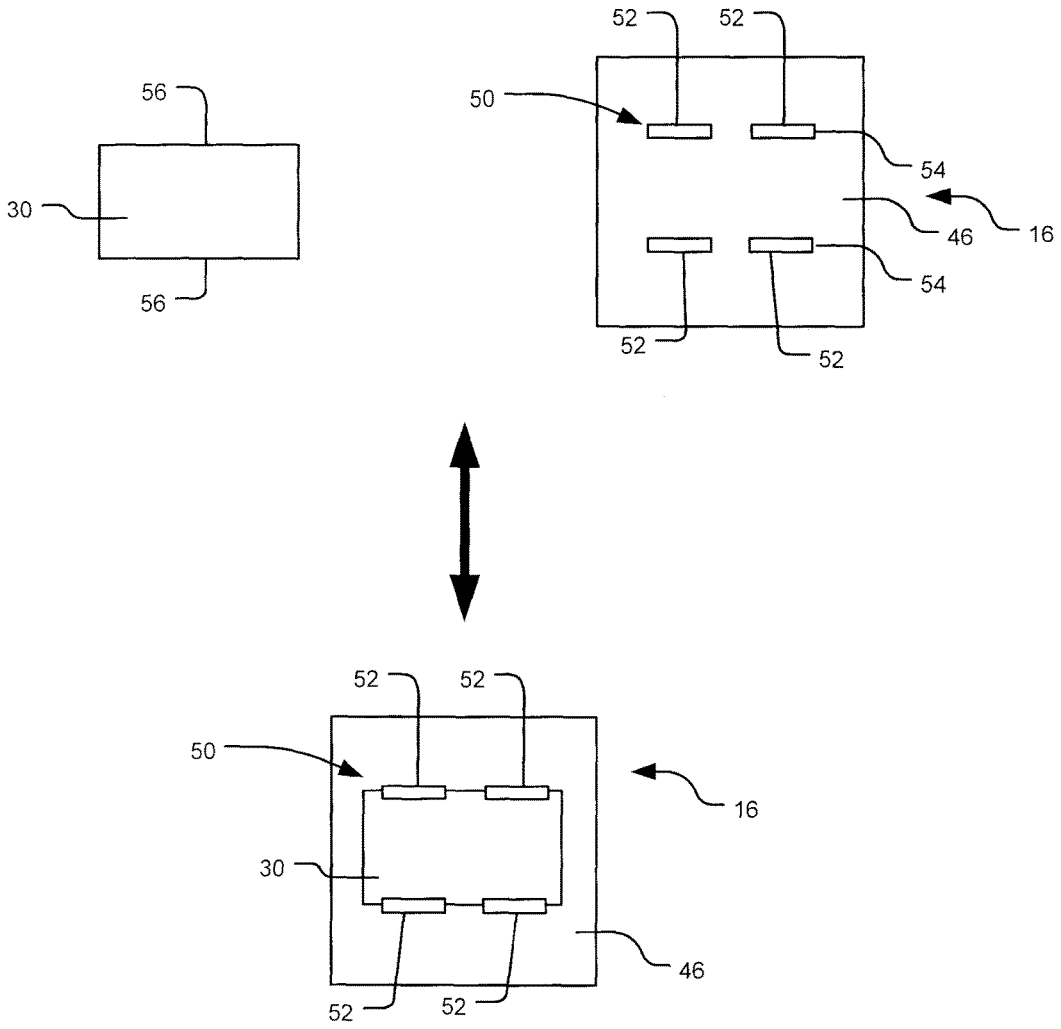
FIG. 20 shows schematic plan views of an alternative embodiment of a head portion of the handle for coupling to an engagement mechanism of the cleaning pad.

FIG. 20 shows an alternative embodiment of engagement mechanism 50 for coupling cleaning pad 16 to head portion 30. Engagement mechanism 50 in FIG. 20 is similar to engagement mechanism 50 in FIG. 19, except that projections 52 are arranged along two parallel lines and defining two parallel and opposed grooves 54. Head portion 30, which is rectangular in this particular embodiment, comprises edges 56 that are slidably receivable in grooves 54, thereby coupling head portion 30 to cleaning pad 16. As will be apparent to a person skilled in the art, many other means for coupling cleaning pad 16 to handle 14 may be envisioned.

Cleaning surface 48 of cleaning pad 16 comprises a non-liquid cleaning composition. The cleaning composition may comprise powdered carbon black. In some embodiments, the cleaning composition comprises carbon black and an additive. For example, the cleaning composition may comprises carbon black and a binding agent, such as hydrated calcium sulfate ($CaSO_4 2H_2O$). In some particular embodiments, the cleaning composition may comprise approximately 90-95% carbon black mixed with approximately 5-10% of hemihydrate of calcium sulfate. In some embodiments, the cleaning composition comprises 92-94% carbon black and 6-8% hemihydrate of calcium sulfate. In a particular embodiment the cleaning composition comprises 93% carbon black and 7% hemihydrate of calcium sulfate. These percentages are by weight. The inventor has empirically determined that a cleaning composition comprising this formulation is particularly effective in cleaning fingerprints and the like from tablet computer touch screens.

The cleaning composition may be impregnated in the cloth or chamois leather or other material in a fine powder form. In one example, the cleaning composition may be made by blending the carbon black and hydrated calcium sulfate constituents in a powdered granular form. The composition may then be loaded on to cleaning surface 48 by contacting cleaning surface 48 with the blended powder.

Cleaning surface 48 may have a surface area that is greater than 1 $cm^2$. In some embodiments, cleaning surface 48 has a surface area of greater than 2, 3, 4, 6, 10, or 15 $cm^2$. In one particular embodiment, cleaning surface 48 has a surface area of 15.2 $cm^2$ (4.0 cm×3.8 cm). It is advantageous for cleaning surface 48 to have a relatively large surface area because many touch screen devices have larger screen surfaces and hence more fingerprint oils than non-touch screen devices. To accommodate a greater load of the cleaning composition, pad member 44 may have a thickness of greater than 0.1 mm. In some embodiments, pad member 44 has a thickness of greater than 0.2, 0.5, 1.0 or 2.0 mm. In one particular embodiment, pad member 44 has a thickness of approximately 1.2 mm. This allows cleaning pad 16 to carry a greater amount of the cleaning composition, which is advantageous for cleaning touch screens with a large residue of fingerprint oils. The greater thickness of pad member 44 also provides a softer feeling while cleaning touch screens. In some embodiments, cleaning surface 48 is square or rectangular. This allows cleaning surface 48 to reach the corners of touch screens which are typically square or rectangular in shape.

Removable coupling of cleaning pad 16 to head portion 30 allows cleaning pad 16 to be replaced with a new pad 16 when cleaning surface 48 is worn out or depleted of the cleaning composition. It is advantageous for cleaning pad 16 to be replaceable rather than fixed because smudged touch screens typically contain a large amount of fingerprint oils and replacement of cleaning pad 16 may be necessary after a number of cleanings (e.g., after about 150 cleanings). Alternatively, apparatus 10 may be disposable and cleaning pad 16 may be fixedly attached to handle 14.

As indicated above, apparatus 10 is adjustable between a stowed configuration (FIG. 18) and a deployed configuration (FIG. 16). Typically, when apparatus 10 is not in use, it is in the stowed configuration. In the stowed configuration, cap 12 is coupled to handle 14 via engagement between rim 20 and rim 32. Coupling between cap 12 and handle 14 creates a sealed enclosure 18A which houses other components of apparatus 10, including cleaning pad 16. When cleaning pad 16 is stowed inside sealed enclosure 18A, cleaning pad 16 is captured within first slot 29A and stays in a folded position, i.e., in an orientation extending generally parallel to neck portion 28 or bottom surface 24B, whereas head and neck portions 28, 30 of handle 14 may be captured inside slot 29B (FIG. 11). Methods for bringing apparatus 10 to the stowed configuration will be described in further detail below.

When apparatus 10 is in use, it is in the deployed configuration (FIG. 16). In the deployed configuration, cap 12 is removed from hand-held cleaning instrument 13 (i.e. handle 14 and cleaning pad 16) such that cleaning pad 16 is fully withdrawn from cap 12. Once cleaning pad 16 is fully withdrawn from cap 12, biasing element 36 forces head portion 30 and attached cleaning pad 16 to pivotally move relative to neck portion 28 until further movement is prevented by abutment members 38. This causes cleaning pad 16 to move from the folded position (FIG. 17) to the extended position (FIG. 16). Typically, the combined effect of biasing element 36 and abutment member 38 keeps cleaning pad 16 to stay at a predetermined angle (e.g., 70°, 80°, 90°, 100°, 110°, or 120° or the like) relative to the longitudinal axis of neck portion 28 of handle 14. FIG. 16 shows an example wherein cleaning pad 16 stays substantially perpendicular to such longitudinal axis of neck portion 28 of handle 14. This allows a user to apply pressure or torque to handle 14 and the tension or torque is effectively transmitted to cleaning pad 16 to act on the touch screen to be cleaned.

In use, apparatus 10 is designed to be used when the touch screen to be cleaned is in a dry condition and hence any water or other liquid droplets should first be removed. The user then holds handle 14 of apparatus 10 and rubs cleaning surface 48 against the touch screen to remove fingerprints or other oily deposits from the screen. It is believed that fingerprints and other oily deposits are adsorbed onto the surfaces of the carbon black particles in the cleaning composition loaded on cleaning surface 48 and thereby removed from the screen.

After the user has finished cleaning the touch screen, the user can return apparatus 10 back to the stowed configuration. To do so, cleaning pad 16 is first adjusted to the folded position (FIG. 17). In one method, a front edge of cleaning pad 16 is brought to rest on flanges 27A, 27B of cap 12 partway within first slot 29A, and the user applies a force on cap 12 which acts on cleaning pad 16 and against the biasing force exerted by biasing element 36 to bring cleaning pad 16 from the extended position to the folded position. The user can then slide the folded cleaning pad 16 into first slot 29A. In this method, the user's fingers do not directly touch cleaning pad 16 and will not be darkened by the carbon black in the cleaning composition. Alternatively, the user can use its finger(s) to act on cleaning pad 16 directly and against the biasing force exerted by biasing element 36 to bring cleaning pad 16 to the folded position and then the user can slide the folded cleaning pad 16 into first slot 29A. Once cleaning pad 16 is fully captured within first slot 29A inside cap 12, neck portion 28 and head portion 30 of handle 14 are similarly captured within second slot 29B inside cap 12. In the stowed configuration, biasing element 36 urges cleaning pad 16 to pivotally move to a small degree which in turn generates a frictional force between cleaning pad 16 and an inner surface of cap 12. This frictional force causes cap 12 to stay coupled together with handle 14 until an external force is applied to cap 12 to pull it away from handle 14.

The user can replace cleaning pad 16 when apparatus 10 is in the deployed configuration. As illustrated in FIGS. 13-16 and 19, to remove an old cleaning pad 16, the user can rotate cleaning pad 16 relative to head portion 30 such that ridges 40 disengage from grooves 54 of projections 52. To install a new cleaning pad 16, the user can position new cleaning pad 16 against head portion 30 with ridges 40 offset from their corresponding projections 52 and then rotate cleaning pad 16 to move ridges 40 into grooves 54 of the corresponding projections 52. In the alternative embodiment as illustrated in FIG. 20, to remove an old cleaning pad 16, the user can slide cleaning pad 16 away from head portion 30 such that edges 56 of head portion 30 disengage from grooves 54 of projections 52. To install a new cleaning pad 16, the user can position new cleaning pad 16 next to head portion 30 and then couple cleaning pad 16 with head portion 30 by sliding edges 56 into grooves 54 of projections 52.

Figure 21:
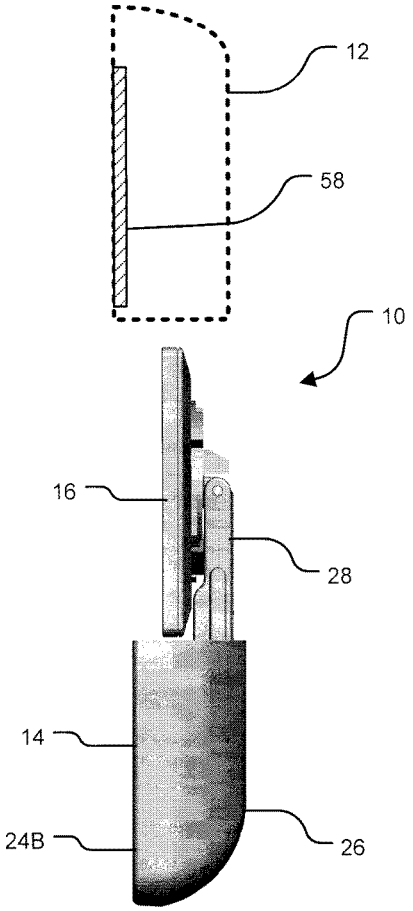
FIG. 21 is a side elevation, partially sectional view of an alternative embodiment of a hand-held cleaning apparatus for cleaning touch screens wherein the cap comprises a replenishment pad.
Figure 22:
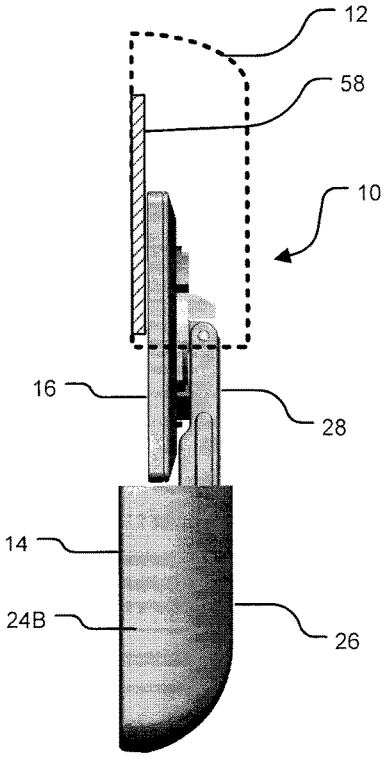
FIG. 22 is a side elevation, partially sectional view of the embodiment of FIG. 21 in a partially stowed configuration.

In an alternative embodiment as illustrated in FIGS. 21 and 22, cap 12 includes a replenishment pad 58 that may also contain a supply of the carbon black cleaning composition. For example, replenishment pad 58 may consist of a foam pad loaded with the cleaning composition. Replenishment pad 58 may also be formed from natural or synthetic chamois leather or microfiber cloth loaded with the cleaning composition. Replenishment pad 58 has an outer surface for contacting cleaning surface 48. When cleaning pad 16 is moved into or out of cap 12, cleaning surface 48 physically (e.g., frictionally) engages replenishment pad 58. This causes a reorienting of the cleaning composition particles impregnated in cleaning pad 16, resulting in a change in the particles disposed on cleaning surface 48 thereof. For example, the reorienting may consist of a repositioning and/or realignment of some of the particles. This change in the cleaning composition particles presents new particle surfaces capable of absorbing oils from the touch screen and hence a replenishment of the cleaning capacity of cleaning surface 48 after each use.

Since replenishment pad 58 is also loaded with particles of the cleaning composition in powder form, the physical contact between cleaning pad 16 and replenishment pad 58 results in interaction between surface particles on pads 16, 58. Since both cleaning pad 16 and replenishment pad 58 are fully loaded or nearly fully loaded with cleaning composition, the physical interaction between pads 16, 58 does not result in a loss of cleaning composition from pad 16 or a significant net transfer of cleaning composition from one pad 16, 58 to the other.

In alternative embodiments, replenishment pad 58 may comprise other materials which cause a reorienting of the cleaner composition particles on cleaning pad 16 without resulting in a significant net loss of particles from pad 16 during each physical engagement.

As will be apparent to those skilled in the art in the light of the foregoing disclosure, many alterations and modifications are possible in the practice of this invention without departing from the spirit or scope thereof. For example, apparatus 10 may additionally comprise a brush for dusting the touch screen. In another example, apparatus 10 may include hand-held cleaning instrument 13, including a non-liquid cleaning composition as described herein, but omitting cap 12.

What is claimed is:

1. A hand-held apparatus for cleaning touch screens comprising:

(a) a handle; and (b) a cleaning pad coupled to said handle and having a cleaning surface, wherein said cleaning surface comprises a non-liquid cleaning composition suitable for cleaning touch screens, said cleaning composition comprising 92-94% carbon black and 6-8% hemihydrate of calcium sulfate.

2. The apparatus as defined in claim 1, comprising a cap removably connectable to said handle for enclosing said cleaning pad when said apparatus is not in use.

3. The apparatus as defined in claim 2, wherein said cap defines an internal compartment, wherein a subcompartment thereof comprises a slot for slidably receiving said pad.

4. The apparatus as defined in claim 2, wherein said handle comprises a body portion, an elongated neck portion extending outwardly from said body portion and a head portion pivotally mounted on said neck portion at an end thereof removed from said body portion, wherein said pad is mounted on said head portion, and wherein said cap defines an internal compartment, wherein a first subcompartment thereof receives said head portion and said cleaning pad in said folded position and a second subcompartment thereof receives said neck when said cap is coupled to said body portion of said handle.

5. The apparatus as defined in claim 2, wherein said cap and said handle together define a sealed enclosure for stowing said cleaning pad when said cap is coupled to said handle.

6. The apparatus as defined in claim 2, wherein said cap comprises a replenishment surface disposed in an interior thereof for contacting said cleaning surface of said pad and replenishing the cleaning capacity of said cleaning composition.

7. The apparatus as defined in claim 6, wherein said cleaning surface frictionally engages said replenishment surface when said cap is moved between an engaged position coupled to said handle and a disengaged position withdrawn from said handle.

8. The apparatus as defined in claim 1, wherein said cleaning pad is pivotally coupled to said handle.

9. The apparatus as defined in claim 8, wherein said cleaning pad is adjustable between a folded position and an extended position.

10. The apparatus as defined in claim 9, wherein said cleaning pad is in said folded position when said cap is coupled to said handle.

11. The apparatus as defined in claim 10, wherein said cleaning pad is biased toward said extended position when said cap is removed from said handle.

12. The apparatus as defined in claim 1, wherein said pad is removably connectable to said handle.

13. The apparatus as defined in claim 1, wherein said handle comprises a body portion, an elongated neck portion extending outwardly from said body portion and a head portion pivotally mounted on said neck portion at an end thereof removed from said body portion, wherein said pad is mounted on said head portion.

14. The apparatus as defined in claim 13, comprising a biasing element coupled to said head portion for biasing said pad toward said extended position.

15. The apparatus as defined in claim 14, wherein said pad extends generally parallel to a longitudinal axis of said neck in said folded position and extends generally perpendicular to said neck in said extended position.

16. The apparatus as defined in claim 13, wherein said cleaning pad comprises an engagement member for removably coupling said cleaning pad to said head portion of said handle.

17. The apparatus as defined in claim 16, wherein said engagement member comprises a plurality of projections, each extending from an undersurface of said cleaning pad and each defining a groove for slidably receiving a portion of said head portion, thereby coupling said head portion to said cleaning pad and permitting force applied to said handle to be transmitted to said cleaning pad.

18. The apparatus as defined in claim 1, wherein said cleaning composition comprises 93% carbon black and 7% hemihydrate of calcium sulfate.

19. The apparatus as defined in claim 1, wherein said cleaning surface has a surface area of greater than 10 $cm^2$.

20. The apparatus as defined in claim 1, wherein said cleaning surface has a thickness of greater than 1.0 mm.

* * * * *